US011710357B2

(12) United States Patent
Baker et al.

(10) Patent No.: US 11,710,357 B2
(45) Date of Patent: Jul. 25, 2023

(54) INTERLOCKABLE DEVICES

(71) Applicant: Hewlett-Packard Development Company, L.P., Spring, TX (US)

(72) Inventors: Mary Gray Baker, Palo Alto, CA (US); Alexander Thayer, Palo Alto, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 16 days.

(21) Appl. No.: 17/423,967

(22) PCT Filed: Apr. 19, 2019

(86) PCT No.: PCT/US2019/028334
§ 371 (c)(1),
(2) Date: Jul. 19, 2021

(87) PCT Pub. No.: WO2020/214188
PCT Pub. Date: Oct. 22, 2020

(65) Prior Publication Data

US 2022/0092895 A1 Mar. 24, 2022

(51) Int. Cl.
*G07C 9/00* (2020.01)
*E05B 67/22* (2006.01)

(52) U.S. Cl.
CPC ..... *G07C 9/00182* (2013.01); *E05B 67/22* (2013.01)

(58) Field of Classification Search
CPC ..... G07C 9/00182; G07C 9/00944; G07C 9/00896; E05B 67/22; E05B 67/00; E05B 73/00
See application file for complete search history.

(56) References Cited

U.S. PATENT DOCUMENTS

| | | | | |
|---|---|---|---|---|
| 4,578,966 | A | 4/1986 | Kasai | |
| 2006/0155388 | A1* | 7/2006 | Pietrzyk | A63H 33/046 700/2 |
| 2015/0158244 | A1 | 6/2015 | Tibbits et al. | |
| 2017/0071309 | A1* | 3/2017 | Chen | A45C 13/10 |
| 2017/0091783 | A1 | 3/2017 | Mancevski et al. | |
| 2017/0157768 | A1* | 6/2017 | Buthala | B25J 9/08 |
| 2018/0190057 | A1 | 7/2018 | Heinz et al. | |
| 2018/0229142 | A1* | 8/2018 | Brandwijk | A63H 33/103 |

FOREIGN PATENT DOCUMENTS

| | | |
|---|---|---|
| RU | 2021455 C1 | 10/1994 |
| RU | 2399736 C1 | 9/2010 |

OTHER PUBLICATIONS

Gilpin, et al., Robot Pebbles: One Centimeter Modules for Programmable Matter through Self-Disassembly, IEEE ICRA'10, Anchorage, Alaska, May 3-8, 2010.

(Continued)

*Primary Examiner* — Nabil H Syed
(74) *Attorney, Agent, or Firm* — Shook, Hardy and Bacon, L.L.P.

(57) ABSTRACT

Examples of devices are described herein. In some examples, a device may include a plurality of electronic elements. In some examples, each of the electronic elements is mechanically interlockable to another of the electronic elements. In some examples, each of the electronic elements is to control a lock state based on a broadcast signal to modify a shape of the device to a predetermined target shape.

15 Claims, 5 Drawing Sheets

(56) References Cited

OTHER PUBLICATIONS

Guigue, Simon "4D Printing': Programming Material To Transform Itself" , Aug. 2014.
Hawkes, Elliot et al. "Programmable matter by folding." Proceedings of the National Academy of Sciences 107, No. 28 (2010): 12441-12445.
Kanter, This crazy 'Dragon' drone can shape-shift in midair to squeeze through tight spaces, Jun. 29, 2018, https://www.businessinsider.com/video-of-shapeshifting-dragon-drone-2018-6, accessed Mar. 29, 2019.
Ramesh, S. et al. "Advancements in the Research of 4D Printing—A Review." In IOP Conference Series: Materials Science and Engineering, vol. 376, No. 1, p. 012123. IOP Publishing, 2018.
Saunders, MIT's 3D Printable Magnetic Ink Creates Rapidly Shape-Sifting Objects, Jun. 14, 2018, https://3dprint.com/216715/magnetic-ink-shape-shifting/, accessed Mar. 29, 2019.
Scott, MIT Uses 3D Printing to Create Shape-Shifting Noodles, May 25, 2017, https://3dprint.com/175826/mit-shape-shifting-noodles/, accessed Mar. 29, 2019.
Scott, Researchers 3D Print Shape-Shifting Objects With New 4D Printing Method, Apr. 13, 2017, https://3dprint.com/171053/shape-shifting-objects-4d-print/, accessed Mar. 29, 2019.

* cited by examiner

INTERLOCKABLE DEVICES

BACKGROUND

Electronic technology has advanced to become virtually ubiquitous in society and has been used to improve many activities in society. For example, electronic devices are used to perform a variety of tasks, including work activities, communication, research, and entertainment. Some kinds of electronic devices work in conjunction with mechanical devices. For instance, some electronic devices may control mechanical devices in electro-mechanical systems. Examples of electro-mechanical systems include garage door openers, automated manufacturing systems, and robotics.

DETAILED DESCRIPTION

Figure 1:
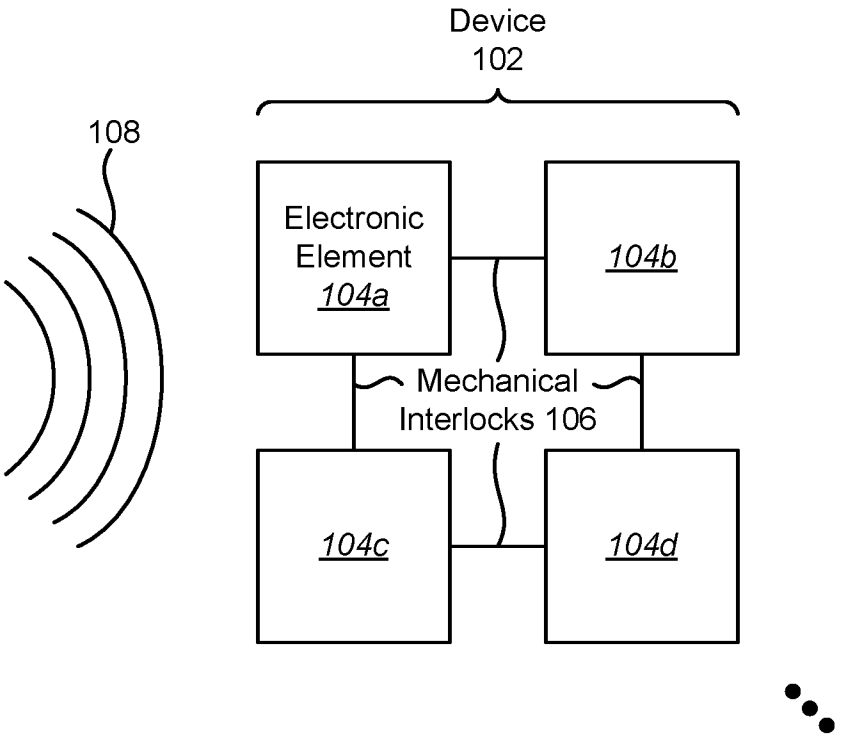
FIG. 1 is a block diagram illustrating an example of a device including a plurality of electronic elements.

Some examples of interlockable devices are described herein. An interlockable device is a device that includes a plurality of elements. An interlockable device element is a component or structure that is mechanically interlockable with another interlockable device element. More specific examples of interlockable devices include two-dimensional (2D) and 3-dimensional (3D) meshes, fabrics, and structures that can change shape. For example, an interlockable device may be programmable to organize itself or change shape based on a signal (e.g., code) that is sent to the elements.

It may be beneficial to change the shape of an interlockable device in a variety of cases. Some examples of employing interlockable devices are given as follows. Interlockable devices may be utilized to protect secret 3D shapes. For example, an interlockable device with a protected shape may be transported as another shape (e.g., a cube). An authorized recipient may send a signal with a secret code to the interlockable device, which may cause the interlockable device to change shape (e.g., have elements fall away) to reveal the protected shape.

In another example, an interlockable device may be utilized to protect or physically redact 2D content. For example, a signal (e.g., code) may be sent to a 3D interlockable device encasing a 2D object. A portion of the 3D printed interlockable device may disperse or fall away to reveal protected letters or shapes on the 2D object.

In another example, an interlockable device may be utilized as tamper-evident packaging. For example, goods may be encased in a locked 3D printed interlockable device (e.g., "fabric" sack). Without the right signal (e.g., code), the interlockable device may not be opened unless broken, which will show evidence of tampering.

In other examples, an interlockable device may be utilized with a timeout. For example, an interlockable device may have a shape with a deadline for disappearing or changing shape. A signal (e.g., code) may be sent at a time to cause all or some of the interlockable device to fall apart.

Throughout the drawings, identical or similar reference numbers may designate similar, but not necessarily identical, elements. Some reference numbers may include a letter (e.g., electronic element 104*a*) to distinguish individual instances of an item. When such a reference number omits the letter, the reference number may refer generally to one, multiple, some, any, or all instances of an item. For example, an "electronic element 104" may refer to one of electronic elements 104*a-d*, some of electronic elements 104*a-d*, any of electronic elements 104*a-d*, or all of electronic elements 104*a-d*. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

FIG. 1 is a block diagram illustrating an example of a device 102 including a plurality of electronic elements 104*a-d*. While FIG. 1 illustrates four electronic elements 104*a-d*, the plurality of electronic elements 104*a-d* may include another number of electronic elements 104 (e.g., two electronic elements 104 or greater than two electronic elements 104). Each electronic element 104 is an electronic device that is a component of the device 102. For example, each electronic element 104 may include circuitry (e.g., a processor, application-specific integrated circuit (ASIC), etc.), memory (e.g., a computer-readable medium, memory cells, registers, etc.), a receiver (e.g., radio frequency (RF) receiver, motion sensor, and/or microphone, etc.), and/or an actuator or actuators. In some examples, each of the electronic elements 104 may be partially or completely 3D printed.

Each of the electronic elements 104 is mechanically interlockable to another of the electronic elements 104. For example, each of the electronic elements 104 may include a mechanical interlock 106 or mechanical interlocks 106 for interlocking the electronic element 104 to another electronic element or other electronic elements. A mechanical interlock 106 is a structure for attaching one electronic element 104 to another electronic element 104. A mechanical interlock 106 may be a metal structure, a plastic structure, a composite structure, and/or may be made of another material. In some examples, the mechanical interlock 106 may function by structural interference. For example, a mechanical interlock 106 may be locked when a structure of one electronic element 104 structurally interferes with a structure of another electronic element 104 such that the locked electronic elements 104 cannot be detached without structurally altering (e.g., damaging or destroying) the mechanical interlock 106 or an electronic element 104. Examples of mechanical interlocks 106 or components mechanical interlocks 106 may include shackles, shanks, clasps, hooks, latches, hasps, screws, plungers, bolts, nuts, eyes, loops, hoops, rings, catches, keepers, shafts, threading, threaded mechanisms, tethers, ties, etc.

A shackle is a structure that is attachable to another structure (e.g., loop, hoop, hook, etc.). For example, a shackle may be a structure that may be situated in physical interference with another structure. A shackle may be unlockable and/or detachable from another structure. For example, a shackle may be moveable to provide a gap or opening when unlocked to allow another structure to pass out of the shackle. In some examples, a shackle may be U-shaped, where the shackle may be extended (from an electronic element 104, for example) to provide a gap that allows a loop to be released from the shackle when unlocked.

In some examples, a mechanical interlock 106 of an electronic element 104 may be complementary to (or compatible with) a mechanical interlock 106 of another electronic element 104. For instance, one electronic element 104*a* may include a shackle, while another electronic element 104*b* may include a loop, where the shackle is situated through the loop when locked. When in a locked state, a mechanical interlock 106 may secure or attach an electronic element 104 to another electronic element 104. When in an unlocked state, a mechanical interlock 106 may detach or allow detachment of an electronic element 104 from another electronic element. For example, a mechanical interlock 106 may provide an opening to allow detachment when unlocked. In some examples, a mechanical interlock 106 may partially or completely release from an electronic element 104 when unlocked. For instance, a mechanical interlock 106 may remain partially attached to an electronic element 104 when unlocked or may completely detach (e.g., fall away) from an electronic element 104 when unlocked.

In some examples, each of the electronic elements 104 may include a plurality of mechanical interlocks 106. For example, an electronic element 104 may include two shackles, three shackles, or another number of shackles. The mechanical interlocks 106 may be operable to attach the electronic element 104 to another electronic element 104 or other electronic elements 104. In an example, an electronic element 104 may include two shackles and two loops. For example, two shackles and two loops may enable an electronic element 104 to be attached to four other electronic elements 104. For instance, the two shackles of the electronic element 104 may be situated through two loops of two other electronic elements 104, and the two loops of the electronic element 104 may receive two shackles of two other electronic elements 104.

In some examples, each mechanical interlock 106 may include a separation mechanism. A separation mechanism is a mechanism that is operable to unlock a mechanical interlock 106. For example, a separation mechanism may separate electronic elements 104 upon unlocking. Examples of separation mechanisms include coils, springs, levers, screws, etc. A separation mechanism may cause the mechanical interlock 106 to spring free or loose when unlocked. For example, each shackle may include a coil that causes the shackle to spring free or loose when unlocked.

In some examples, the device 102 may include mechanical interlocks 106 in two dimensions or three dimensions. In some examples, each of the electronic elements 104 may be rectangular or square in shape. For instance, each of the electronic elements 104 may include four interlocking sides, where shackles are situated on two of the sides and loops are situated on the other two sides. In some examples, each of the electronic elements 104 may be a rectangular prism or cube in shape. For instance, each of the electronic elements 104 may include six interlocking sides, where shackles are situated on three of the sides and loops are situated on the other three sides. Other shapes may be implemented. For example, each of the electronic elements 104 may be square, rectangular, trapezoidal, curved, angular, circular, elliptical, polygonal, prismatic, spherical, cubical, and/or irregularly shaped, etc. In some examples, different electronic elements 104 of the device 102 may be shaped differently.

In some examples, each of the electronic elements 104 may control a lock state based on a broadcast signal 108. Changing the lock state may modify a shape of the device 102 to a predetermined target shape. Some examples of the device 102 disclosed herein may not accidentally change shape in the presence of magnets, heat, or water. Some examples of the device 102 may not utilize continuous action to maintain device 102 shape. In some examples, the device 102 may change shape based on one action (e.g., receiving a broadcast signal 108 to unlock specific mechanical interlocks 106).

The broadcast signal 108 is a signal that indicates whether each of the electronic elements 104 should change a lock state. Examples of the broadcast signal 108 may include an electromagnetic signal, a light signal, a radio frequency (RF) signal, a motion signal, and/or an audio signal. In some examples, each of the electronic elements 104 may include a receiver to receive the broadcast signal 108. A receiver is a device that receives signals. Examples of receivers include electromagnetic signal receivers, light signal receivers (e.g., photo detectors), RF receivers, motions sensors, and/or microphones. In some examples, an electronic device (e.g., electromagnetic signal transmitter, light source, RF transmitter, smart phone, Bluetooth transmitter, Wi-Fi transmitter, router, base station, motion table, audio system, speaker, etc.) may transmit the broadcast signal 108 to the device 102. In some examples, a user may transmit the broadcast signal 108 (e.g., may speak or sing an audio signal, may move the device 102, etc.).

In some examples, the broadcast signal 108 indicates a plurality of identifiers. An identifier is a signal or code that corresponds to one of the electronic elements. Examples of identifiers may include numeric codes, character strings, addresses, modulation patterns, sounds, words, motions, light patterns, electromagnetic signal patterns, etc. Each of the plurality of identifiers may respectively correspond to each of the plurality of electronic elements 104.

In some examples, each of the identifiers may have an associated lock code. A lock code is a signal or code that indicates a lock state for an electronic element 104. A lock state is a state for a lock or locks. For example, a lock state of an electronic element 104 with two mechanical interlocks 106 may indicate that both mechanical interlocks 106 are locked, that both mechanical interlocks 106 are unlocked, or that one mechanical interlock 106 is locked while the other mechanical interlock 106 is unlocked. Portions of the lock code may correspond to respective mechanical interlocks 106 and/or may dictate a lock state for respective mechanical interlocks 106. In some examples, the lock code may include a set of digits, where each of the digits indicates a lock state (e.g., "0" for unlocked, "1" for locked). Other examples of the lock code may be longer, more complicated, and/or not easily guessable. For instance, one portion of a lock code may include an apparently random set of bits that will serve to unlock a mechanical interlock 106 if the set of bits matches a set of bits stored on an electronic element 104. Accordingly, a broadcast signal 108 may be sent that imparts a lock code to each electronic element 104 that causes the electronic element to change a local lock state in a way that affects the global shape of the device 102.

In some examples, each of the electronic elements 104 may determine a lock code from the broadcast signal 108. Portions of the lock code may respectively correspond to respective interlock mechanisms 106. Each of the electronic elements 104 may control each of the interlock mechanisms 106 independently based on each portion of the lock code. For example, each of the electronic elements 104 may determine a two-digit code from the broadcast signal 108. Each digit of the two-digit code may respectively correspond to one of two shackles. Each of the electronic elements 104 may control each of the two shackles independently based on each corresponding digit of the two-digit code.

Each of the electronic elements 104 may control a mechanical interlock 106 or mechanical interlocks 106 based on the broadcast signal 108. For example, each electronic element 104 may include a mechanism to unlock a mechanical interlock 106 or mechanical interlocks 106. For instance, each of the electronic elements 104 may control each of the mechanical interlocks 106 independently based on each corresponding portion of the lock code. In some examples, an electronic element 104 may power an electromechanical actuator that moves to release a mechanical interlock 106 when unlocking. For instance, an actuator may move a structure (e.g., extend a shackle, release a shackle, rotate a screw, etc.) to allow a mechanical interlock to unlock. In some examples, unlocking may be achieved through structural warping. For example, each electronic element 104 may include a resistor or resistors. When unlocking, current may be provided to the resistors, which may heat a mechanical interlock 106 to warp the structure of the mechanical interlock 106 in order to unlock.

In some examples, each of the electronic elements 104 may include a power source. Examples of power sources include batteries, solar cells, motion power generators, inductive coils, power ports, etc. In some examples, each of the electronic elements 104 may generate power based on a wireless signal. For example, an electronic element 104 may utilize a wireless signal (e.g., Wi-Fi backscatter, inductive charging signal, etc.) to generate power. The power may be utilized to power the components of the electronic element 104 (e.g., circuitry, processor, ASIC, memory, receiver, and/or actuator(s), etc.).

Figure 2:
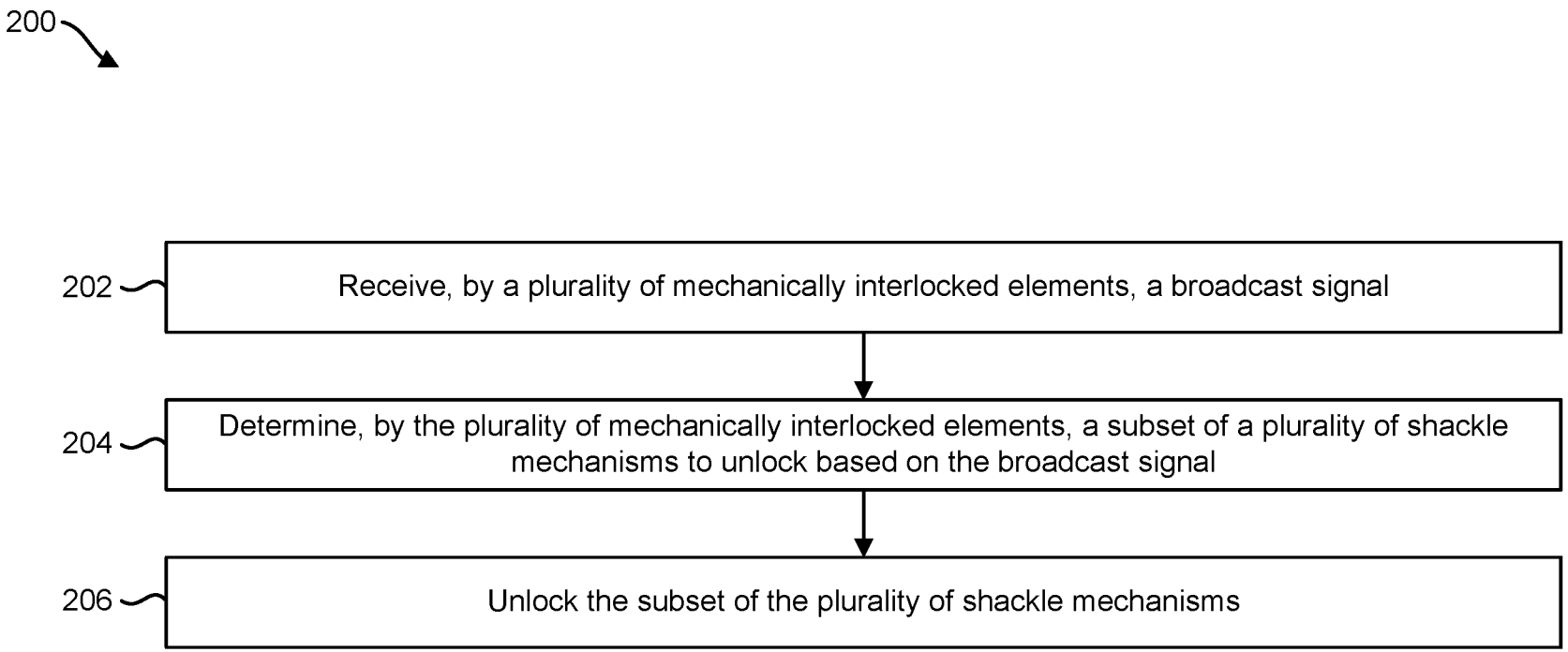
FIG. 2 is a flow diagram illustrating an example of a method for controlling a plurality of mechanically interlocked elements.

FIG. 2 is a flow diagram illustrating an example of a method 200 for controlling a plurality of mechanically interlocked elements. In some examples, the method 200 may be performed by the device 102 and/or electronic elements 104 described in connection with FIG. 1. The mechanically interlocked elements may be examples of the electronic elements described in connection with FIG. 1.

A plurality of mechanically interlocked elements may receive 202 a broadcast signal. This may be accomplished as described in connection with FIG. 1. For example, each of the mechanically interlocked elements may receive 202 an RF signal, a motion signal, and/or an audio signal. The broadcast signal may be received with an RF receiver, a motion sensor (e.g., accelerometers), and/or microphones.

The plurality of mechanically interlocked elements may determine 204 a subset of a plurality of shackle mechanisms to unlock based on the broadcast signal. This may be accomplished as described in connection with FIG. 1. For example, determining the subset to unlock may include determining from the broadcast signal, by each of the plurality of mechanically interlocked elements, a respective code indicating whether to unlock a shackle or shackles of a respective mechanically interlocked element. For instance, each mechanically interlocked element may determine a code (e.g., lock code). The code may indicate whether that mechanically interlocked element should unlock one, some, all, or none of the shackles of the mechanically interlocked element. In some examples, a shackle mechanism may include a shackle and a mechanism to unlock the shackle (e.g., a lock actuator, a warping material, and/or a coil, etc.).

In some examples, determining 204 the subset to unlock may include decrypting the broadcast signal by each of the plurality of mechanically interlocked elements. Additionally or alternatively, determining 204 the subset to unlock may include decoding the broadcast signal by each of the plurality of mechanically interlocked elements to determine the respective code.

The plurality of mechanically interlocked elements may unlock 206 the subset of the plurality of shackle mechanisms. This may be accomplished as described in connection with FIG. 1. For example, a mechanically interlocked element may control an actuator or actuators to unlock a shackle or shackles of the subset. Additionally or alternatively, a mechanically interlocked element may cause a resistor or resistors to produce heat to unlock the shackle or shackles of the subset through structural warping.

Figure 3:
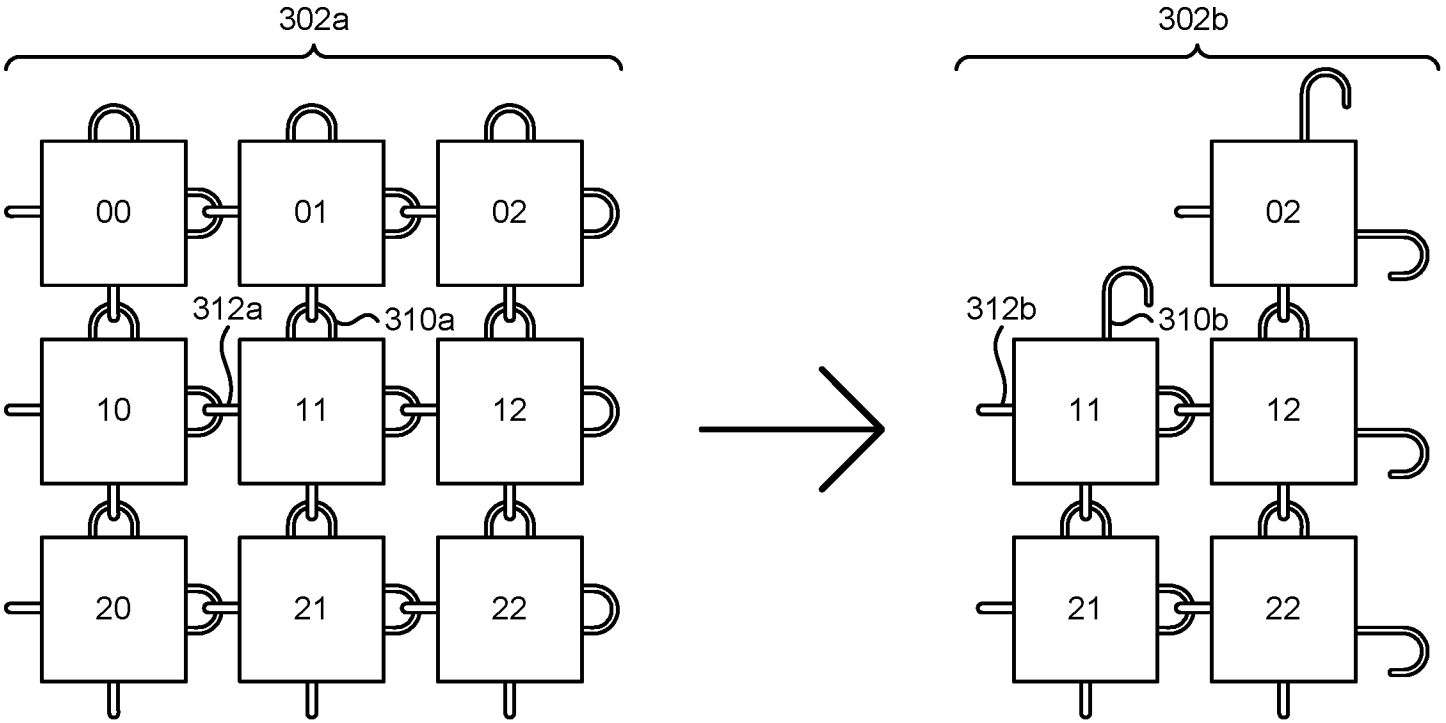
FIG. 3 is a diagram illustrating an example of a device before unlocking and the device after unlocking.

FIG. 3 is a diagram illustrating an example of a device before unlocking 302*a* and the device after unlocking 302*b*. In some examples, the device 302 may be an example of the device 102 described in connection with FIG. 1 and/or may operate in accordance with the method 200 described in connection with FIG. 2. In this example, the device 302 includes a plurality of electronic elements, where each of the electronic elements includes two shackles and two loops. The shackles are unlockable and the loops are static structures. One shackle 310 and one loop 312 are labeled for convenience.

In this example, each of the electronic elements is individually identifiable as described in connection with FIG. 1. For instance, the numbers illustrated in association with the electronic elements represent an identifier (e.g., identification number) for each electronic element. Each shackle on an electronic element may be in one of two states: locked or unlocked. For two-dimensional devices, there may be two shackles per electronic element. For three-dimensional devices, there may be three shackles per electronic element. The example of FIG. 3 illustrates mechanical interlocking in two dimensions.

In some examples, a lock code may be utilized to dictate the state of the shackles. For instance, an electronic element that receives a code "00" may unlock both shackles. A code "01" may unlock a top shackle but not a side shackle. A code "11" may leave both shackles locked. In some examples, the lock state may be relative to an initial state. In the example of FIG. 3, the device 302*a* on the left-hand illustrates an example of an initial state, where a fabric is created with all electronic elements locked and interconnected.

In this example, a broadcast signal is sent to the device 302*a* that indicates the following message, where "ID" denotes an identifier and "value" is an example of a lock code associated with the identifier: {ID 00: value 00, ID 01: value 00, ID 02: value 00, ID 10: value 00, ID 11: value 01, ID 12: value 10, ID 20: value 00, ID 21: value 11, ID 22: value 10}. In this example, electronic elements with IDs 00, 01, 10, and 20 fall away, because they become detached from the device 302. Accordingly, the device 302*b* has a target shape with electronic elements with IDs 02, 11, 12, 21, and 22. For instance, a shackle 310*a* becomes an unlocked shackle 310*b*, which allows the electronic element 01 to detach. Additionally, a shackle of electronic element 10 in initially coupled with the loop 312*a* and is then unlocked from the loop 312*b*, allowing the electronic element 10 to detach.

In other examples (for a more secure device), each shackle on each electronic element may utilize a longer and/or random code to unlock. The longer and/or random code may not be easily guessable.

As described above, electronic elements may receive codes wirelessly in some examples. For instance, each electronic element may include an embedded low-power wireless networking card to enable reception of the broadcast signal (e.g., code). In some examples, each electronic element may include a receiver and may not include a transmitter to secure the device (e.g., secure the identifiers in memory, to avoid enabling scanning, etc.). In some examples, the electronic elements may not communicate with each other (e.g., send signals to each other). In some examples, each of the electronic element may utilize passive energy harvesting (e.g., from Wi-Fi backscatter or other signals) to power each electronic element's components.

As described herein, each electronic element may be identifiable such that that each electronic element can differentiate a portion of the broadcast signal (e.g., code) for a response. In the example of FIG. 3, simple identifiers are utilized depending on the electronic element's initial location in the device (e.g., fabric). In other examples, electronic elements may have more complicated identifiers based on a mapping between identifiers and a location of the electronic element in the device (e.g., fabric). In some examples, identifiers may be assigned using a media access control (MAC) address for each electronic element as a unique identifier. Other secure schemes for unique identifiers may be implemented via a secure storage element in each electronic element.

As mentioned above, passive energy harvesting may be utilized to power the components (e.g., embedded wireless network) in each electronic element. As also described herein, a mechanical aspect may be enabled that allows the mechanical interlocks (e.g., shackles) to become unlocked. In some examples, the mechanical interlocks may be powered with passive energy harvesting. Additionally or alternatively, solar power, batteries, or another power source may be utilized.

Given a power source, one example of a mechanical actuator may utilize embedded resistors. For example, an electronic element may be 3D printed with embedded circuitry including resistors. The resistors may be utilized to warp material via a temperature change (e.g., heating from the embedded resistors) to causing a shackle to lock or unlock via the warping. As described herein, it may be beneficial for electronic elements to fall away when unlocked. In some examples, shackles may be made from coils that spring free or loose upon unlocking. In some approaches, the coils may utilize manipulation to relock.

Figure 4:
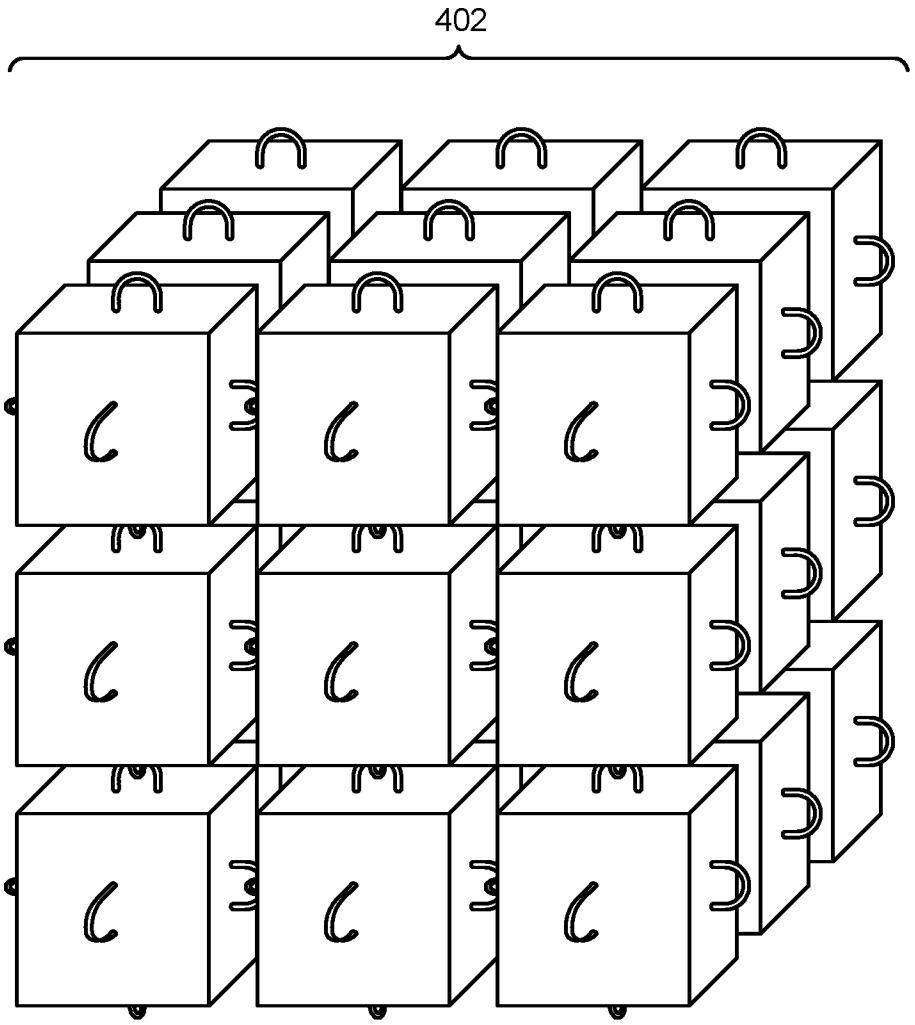
FIG. 4 is a diagram illustrating an example of a device with three-dimensional (3D) electronic elements.

FIG. 4 is a diagram illustrating an example of a device 402 with 3D electronic elements. In this example, each of the electronic elements may include three shackles and three loops. Utilizing a broadcast signal (e.g., RF signal, motion, and/or audio) may enable communication to interior electronic elements, which may be controlled via the broadcast signal.

Figure 5:
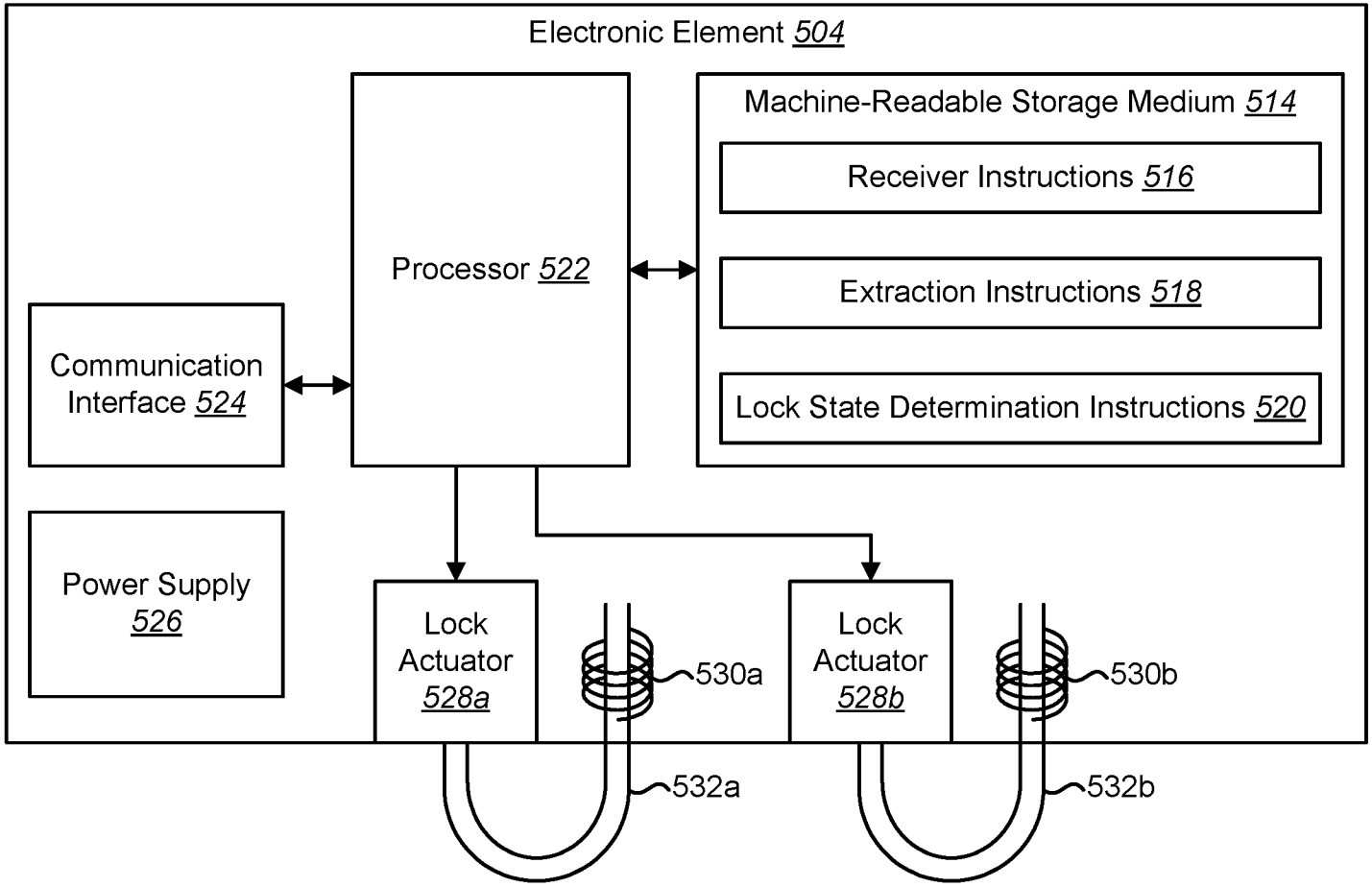
FIG. 5 is a block diagram of an example of an electronic element.

FIG. 5 is a block diagram of an example of an electronic element 504. In this example, the electronic element 504 includes a processor 522 and a machine-readable storage medium 514 (e.g., memory). The processor 522 executes instructions stored in the machine-readable storage medium 514 to perform a variety of operations. For example, the processor 522 may run a program, which is a set of instructions or code that performs an operation when executed by the processor 522. The electronic element 504 may include a communication interface 524, a power supply 526, lock actuators 528, shackles 532, and/or coils 530. The electronic element 504 may include additional components (not shown) and/or some of the components described herein may be removed and/or modified without departing from the scope of this disclosure.

The processor 522 may be any of a central processing unit (CPU), a semiconductor-based microprocessor, field-programmable gate array (FPGA), an application-specific integrated circuit (ASIC), and/or other hardware device suitable for retrieval and execution of instructions stored in the machine-readable storage medium 514. The processor 522 may fetch, decode, and/or execute instructions (e.g., receiver instructions 516, extraction instructions 518, and/or lock state determination instructions 520) stored on the machine-readable storage medium 514. It should be noted that the processor 522 may be configured to perform any of the functions, operations, techniques, methods, etc., described in connection with FIGS. 1-4 in some examples.

The machine-readable storage medium 514 (e.g., memory) may be any electronic, magnetic, optical, or other physical storage device that contains or stores electronic information (e.g., instructions and/or data). Thus, the machine-readable storage medium 514 may be, for example, random access memory (RAM), dynamic random access memory (DRAM), electrically erasable programmable read-only memory (EEPROM), magnetoresistive random-access memory (MRAM), phase change RAM (PCRAM), memristor, flash memory, a storage device, hard drive, magnetic disk, flash memory, and the like. In some implementations, the machine-readable storage medium 514 may be a non-transitory machine-readable storage medium, where the term "non-transitory" does not encompass transitory propagating signals. The machine-readable storage medium 514 (e.g., memory) may be coupled to the processor 522. An instruction set stored on the machine-readable storage medium 514 (e.g., memory) may cooperate with the processor 522 (e.g., may be executable by the processor 522) to perform any of the functions, operations, methods, techniques, and/or procedures described herein.

Examples of instructions and/or data that may be stored in the machine-readable storage medium 514 include receiver instructions 516, extraction instructions 518, and/or lock state determination instructions 520.

In some examples, the electronic element 504 may include a communication interface 524. The communication interface 524 may enable communication between the electronic element 504 and one or more other electronic devices. For example, the communication interface 524 may provide an interface for wireless communications. In some examples, the communication interface 524 may be coupled to one or more antennas (not shown in FIG. 5) for transmitting and/or receiving radio frequency (RF) signals. For example, the communication interface 524 may enable one or more kinds of wireless (e.g., personal area network (PAN), Bluetooth, cellular, wireless local area network (WLAN), etc.) communication.

In some examples, multiple communication interfaces 524 may be implemented and/or utilized. For example, one communication interface 524 may be a PAN (e.g., Bluetooth) communication interface 524, another communication interface 524 may be a Zigbee communication interface 524, another communication interface 524 may be a wireless local area network (WLAN) interface (e.g., Institute of Electrical and Electronics Engineers (IEEE) 802.11 interface), and/or another communication interface 524 may be a cellular communication interface 524 (e.g., 3G, Long Term Evolution (LTE), Code Division Multiple Access (CDMA), etc.). In some configurations, the communication interface(s) 524 may send information (e.g., programming acknowledgement) to an electronic device (e.g., smart phone, tablet device, computer, etc.) and/or receive information (e.g., programming signals, broadcast signals, etc.) from an electronic device (e.g., smart phone, tablet device, computer, etc.).

Additional examples of communication interfaces 524 include electromagnetic signal receivers, light signal receivers (e.g., light sensors, photo detectors, etc.), motion sensors, and/or microphones. In some examples, the communication interface 524 may determine and/or capture motion sensor samples and/or audio samples.

In some examples, the electronic element 504 may include a lock actuator 528 or lock actuators 528. The lock actuators 528 may be controllable by the processor 522 to lock and/or unlock a shackle 532 or shackles 532. In some examples, the electronic element 504 may include coils 530 to spring the shackles 532 free or loose when unlocked. While two lock actuators 528*a-b*, shackles 532*a-b*, and coils 530*a-b* are illustrated in FIG. 5, other numbers of lock actuators 528*a-b*, shackles 532*a-b*, and/or coils 530*a-b* may be implemented. In some examples, the electronic element 504 may be a mechanically interlocked element of a device. A mechanically interlocked element of a device is an electronic element that is mechanically interlocked to another electronic element.

The power supply 526 may supply power (e.g., electrical power, voltage, current, etc.) to the components of the electronic element 504. The power supply 526 may include a power source and/or circuitry for supplying power. For example, the power supply 526 may supply power to the communication interface 524, the processor 522, the machine-readable storage medium 514, and/or the lock actuator(s) 528. Some examples of the power supply 526 may include a battery, solar cells, motion power generator, inductive coil, power port, etc.

The processor 522 may be in electronic communication with the machine-readable storage medium 514 (e.g., memory). As described above, the processor 522 may execute instructions (e.g., receiver instructions 516 instructions, extraction instructions 518, and/or lock state determination instructions 520) stored in the machine-readable storage medium 514. The instructions may be loaded into the processor 522 for execution.

The processor 522 may execute receiver instructions 516 to receive a broadcast signal. For example, the receiver instructions 516 may be executed to capture samples of a broadcast signal (e.g., an RF signal, a motion signal, and/or an audio signal). In some examples, the samples of the broadcast signal may be stored in the machine-readable storage medium 514. In some examples, the broadcast signal may be received from a device (e.g., an RF transmitter). In some examples, the processor 522 may execute the receiver instructions 516 to downconvert and/or demodulate the broadcast signal. The broadcast signal may be sent to all of the electronic elements in a plurality of electronic elements. In some examples, the broadcast signal may include individual information for each electronic element.

In some examples, the processor 522 may execute the extraction instructions 518 to extract a portion of the broadcast signal corresponding to one of a plurality of electronic elements (e.g., mechanically interlocked elements) of a device. For example, the processor 522 may extract a portion of the broadcast signal corresponding to the electronic element 504. In some examples, the processor 522 may identify a portion of the broadcast signal with an identifier corresponding to the electronic device 504. For instance, the processor 522 may parse the broadcast signal for an identifier that matches an identifier stored in the machine-readable storage medium 514. In some examples, the broadcast signal may be indexed in accordance with an identifier or code stored in the machine-readable storage medium 514. Accordingly, the processor 522 may extract the portion of the broadcast signal corresponding to the indexing. In some examples, the processor 522 may execute the extraction instructions 518 to decrypt, decode, and/or descramble the broadcast signal in order to extract the portion.

In some examples, the portion of the broadcast signal may be a lock code corresponding to the electronic element 504. For example, the portion may indicate target states for the lock actuator(s) 528. For instance, the portion may include multiple indicators, where each indicator indicates a target state for each shackle 532*a-b*.

In some examples, the processor 522 may execute the lock state determination instructions 520 to determine whether to unlock each of a plurality of shackles 532 based on respective indicators of the portion. For example, the processor 522 may read the respective indicators to determine whether each of the respective indicators indicates that a corresponding shackle 532 should be unlocked.

In some examples, the electronic element 504 (e.g., one of the plurality mechanically interlocked elements) may include three shackles 532 and three loops. In some examples, the indicators of the portion may include a three-digit code. For example, each digit of the three-digit code may respectively correspond to one of the three shackles 532 and each digit may indicate whether to unlock one of the three shackles 532.

In some examples, the processor 522 may execute the lock state determination instructions 520 to unlock a shackle 532 or shackles 532 of the plurality of shackles 532 to change a shape of the device based on the determination of whether to unlock each of the plurality of shackles 532 based on the respective indicators of the portion.

In some examples, the shape of a device may be modified based on the broadcast signal to a predetermined target shape. For example, the broadcast signal may represent the predetermined target shape. In some examples, the predetermined target shape may be a confidential or protected shape. In some examples, the predetermined target shape may be a shape to allow access to an item. For example, the device may be packaging, a casing, or bag for an item, and the predetermined target shape may allow the packaging, casing, or bag to be opened.

It should be noted that while various examples of systems and methods are described herein, the disclosure should not be limited to the examples. Variations of the examples described herein may be implemented within the scope of the disclosure. For example, one or more operations, functions, aspects, or elements of the examples described herein may be omitted or combined.

The invention claimed is:

1. A device, comprising:

a plurality of electronic elements, wherein each of the electronic elements is mechanically interlockable to another of the electronic elements, and wherein each of the electronic elements is to control a lock state based on a broadcast signal to modify a three-dimensional (3D) shape of the device to a predetermined target shape, the 3D shape of the device enclosing, protecting, or physically redacting a 3D or two-dimensional (2D) object revealed or made accessible by the predetermined target shape.

2. The device of claim 1, wherein the broadcast signal indicates a plurality of identifiers, wherein each of the plurality of identifiers respectively corresponds to each of the plurality of electronic elements.

3. The device of claim 1, wherein each of the electronic elements comprises a plurality of mechanical interlocks.

4. The device of claim 3, wherein each of the mechanical interlocks comprises a separation mechanism to spring free when unlocked.

5. The device of claim 3, wherein each of the electronic elements comprises two shackles and two loops.

6. The device of claim 3, wherein each of the electronic elements is to:

determine a lock code from the broadcast signal, wherein portions of the lock code respectively correspond to respective mechanical interlocks; and control each of the mechanical interlocks independently based on each corresponding portion of the lock code.

7. The device of claim 1, wherein the broadcast signal is an electromagnetic signal, a light signal, radio frequency (RF) signal, a motion signal, or an audio signal.

8. The device of claim 1, wherein each of the electronic elements is to generate power based on a wireless signal.

9. The device of claim 1, wherein each of the electronic elements comprises a receiver to receive the broadcast signal.

10. A method, comprising:

receiving, by a plurality of mechanically interlocked elements, a broadcast signal;

determining, by the plurality of mechanically interlocked elements, a subset of a plurality of shackle mechanisms to unlock based on the broadcast signal; and unlocking the subset of the plurality of shackle mechanisms, the unlocking revealing or making accessible a three-dimensional (3D) or two-dimensional (2D) object protected or redacted by the plurality of mechanically interlocked elements.

11. The method of claim 10, wherein determining the subset to unlock comprises determining from the broadcast signal, by each of the plurality of mechanically interlocked elements, a respective code indicating whether to unlock a shackle or shackles of a respective mechanically interlocked element.

12. The method of claim 11, wherein determining the subset to unlock comprises:

decrypting, by each of the plurality of mechanically interlocked elements, the broadcast signal; and decoding, by each of the plurality of mechanically interlocked elements, the broadcast signal to determine the respective code.

13. A non-transitory machine-readable storage medium encoded with instructions executable by a processor, the machine-readable storage medium comprising instructions to:

receive a broadcast signal;

extract a portion of the broadcast signal corresponding to one of a plurality of mechanically interlocked elements of a device;

determine whether to unlock each of a plurality of shackles based on respective indicators of the portion; and unlock a shackle or shackles of the plurality of shackles to change a three-dimensional (3D) shape of the device based on the determination, the 3D shape of the device enclosing, protecting, or physically redacting a 3D or two-dimensional (2D) object revealed or made accessible by unlocking the shackle or shackles of the plurality of shackles.

14. The storage medium of claim 13, wherein the one of the plurality of mechanically interlocked elements comprises three shackles and three loops.

15. The storage medium of claim 14, wherein the indicators of the portion comprise a three-digit code, wherein each digit of the three-digit code respectively corresponds to one of the three shackles and each digit indicates whether to unlock one of the three shackles.

* * * * *